US007789813B2

(12) United States Patent
Anderson

(10) Patent No.: US 7,789,813 B2
(45) Date of Patent: Sep. 7, 2010

(54) DUMBBELL AND ADAPTOR WITH SECURABLE INCREMENTAL WEIGHT PLATE FEATURE

(75) Inventor: Karl Anderson, Glendora, CA (US)

(73) Assignees: Ace Specialty, Inc., Rosemead, CA (US); Grace Premier Fitness & Wellness Products, Inc., Vancouver, WA (US)

( * ) Notice: Subject to any disclaimer, the term of this patent is extended or adjusted under 35 U.S.C. 154(b) by 649 days.

(21) Appl. No.: 11/425,962

(22) Filed: Jun. 22, 2006

(65) Prior Publication Data

US 2007/0298939 A1 Dec. 27, 2007

(51) Int. Cl.
*A63B 21/072* (2006.01)
*A63B 21/075* (2006.01)

(52) U.S. Cl. ..... 482/107; 482/106; 482/108

(58) Field of Classification Search ..... 482/106–109, 482/92, 93

See application file for complete search history.

(56) References Cited

U.S. PATENT DOCUMENTS

| | | | | |
|---|---|---|---|---|
| 1,991,520 | A * | 2/1935 | Postl | 482/108 |
| 3,320,564 | A | 5/1967 | Sosey et al. | |
| 3,606,314 | A * | 9/1971 | Popp | 482/92 |
| 4,076,236 | A | 2/1978 | Ionel | |
| 4,529,197 | A * | 7/1985 | Gogarty | 482/107 |
| 4,566,690 | A * | 1/1986 | Schook | 482/108 |
| 4,579,337 | A * | 4/1986 | Uyeda | 482/107 |
| 4,661,813 | A | 4/1987 | Mazzamauro et al. | |
| 4,768,780 | A | 9/1988 | Hayes | |
| 4,893,810 | A * | 1/1990 | Lee | 482/107 |
| 4,971,305 | A | 11/1990 | Rennex | |
| 5,256,121 | A | 10/1993 | Brotman | |
| 5,344,375 | A | 9/1994 | Cooper | |
| 5,348,522 | A * | 9/1994 | Brotman | 482/98 |
| 5,407,413 | A | 4/1995 | Kupferman | |
| 5,628,716 | A * | 5/1997 | Brice | 482/106 |

(Continued)

FOREIGN PATENT DOCUMENTS

WO 2007/096864 A2 8/2007

(Continued)

OTHER PUBLICATIONS

Co-pending U.S. Appl. No. 11/425,968 filed Jun. 22, 2006, Office Actions, responses and art cited therein.

*Primary Examiner*—Loan H Thanh
*Assistant Examiner*—Allana Lewin
(74) *Attorney, Agent, or Firm*—Seldon & Scillieri

(57) ABSTRACT

A dumbbell having weight plates onto which magnetically coupled incremental weight plates can be securely mounted comprises a bar, weights at the end regions of the bar, means for retaining the weight plates at the respective ends to define a handle region therebetween, and a sleeve of generally annular cross-section securely mounted about the bar at least one end region axially outward from the weight plate, said sleeve member having (a) a hub portion for accommodating the through-opening of a weight plate, and (b) a flange portion of greater exterior dimension than the hub portion and having at least one magnetically-responsive region for magnetically securing an incremental weight to the dumbbell when said incremental weight plate is mounted about said hub region. In accordance with the invention, an adaptor to convert conventional dumbbells to utilize magnetically-coupled incremental weight plates comprises elements (a) and (b) above.

48 Claims, 3 Drawing Sheets

U.S. PATENT DOCUMENTS

| | | | | |
|---|---|---|---|---|
| 5,735,777 | A * | 4/1998 | Benoit et al. | 482/93 |
| 6,261,211 | B1 | 7/2001 | Suarez et al. | |
| 6,971,974 | B2 | 12/2005 | Bowman et al. | |
| 7,137,931 | B2 | 11/2006 | Liu | |
| 7,172,536 | B2 | 2/2007 | Liu | |
| 2003/0017919 | A1 * | 1/2003 | Lanoue | 482/107 |
| 2004/0072662 | A1 | 4/2004 | Landfair | |
| 2006/0172872 | A1 | 8/2006 | Nasir | |
| 2007/0117692 | A1 | 5/2007 | Towley et al. | |
| 2007/0298940 | A1 | 12/2007 | Anderson | |

FOREIGN PATENT DOCUMENTS

| | | | |
|---|---|---|---|
| WO | WO 2007096864 | A2 * | 8/2007 |

* cited by examiner

DUMBBELL AND ADAPTOR WITH SECURABLE INCREMENTAL WEIGHT PLATE FEATURE

FIELD OF THE INVENTION

This invention pertains to barbells and dumbbells. Unless otherwise stated, the term "dumbbell" shall be used to mean "barbell" and "dumbbell", individually and collectively There are two fundamental types of dumbbells: the "fixed weight" type, wherein the weight plates are permanently secured on the ends of an axially-extending bar, and the "adjustable" type, wherein weight plates are secured on an axially-extending bar by removable collars that permit the user to add or remove individual weight plates to the bar.

The fixed weight type dumbbell is typically part of a set that provides a range of liftable weights, typically in 5 lb. increments. The weight plates of each such dumbbell are secured to the bar by one of a number of known means. For example, the weight plate(s) at each end of the bar may simply be captured between an axially inner flange and an annular collar mounted about the end region of the bar. Both end regions of the bar may be internally threaded in the axial direction to engage respective externally-threaded bolts that are accordingly tightened into the bar to secure a respective end cap against the weight plate(s) and thereby capture the weight plate(s) against the flange. A high-strength thread locker such as Loctite® is then preferably used to prevent the bolt from becoming loose, and uncommon bolt heads or other types of fasteners may be employed to prevent the user from intentionally loosening the plates.

Similarly, adjustable dumbbells are known to use a variety of means for releasably securing the weight plates to the bar. One version utilizes a bar having externally-threaded end regions that engage an internally-threaded annular collar that is spun onto the bar and tightened against the weight plates to capture the weight plates against an axially inner flange. Such collars sometimes include wrench-engageable surface features to enhance the user's ability to securely tighten the collar onto the dumbbell. The collar can subsequently be removed in order to add or remove weight plates by unscrewing the collar from the bar.

Other means for releasably securing the weight plates to dumbbells of both the fixed and adjustable types are well known, and it will be understood that the invention herein is usable and adaptable for use with all of them, and not limited to the configurations described herein by way of example.

Whether a fixed weight type or an adjustable type dumbbell is used, it is frequently desirable to use an easily and quickly mountable and detachable weight plate that can add or subtract incremental weight to the existing weight plate combination on the dumbbell. For simplicity, this easily mountable and detachable weight plate will be referred to as an "incremental" weight plate because (as will become clear) it is used to incrementally vary the weight to be lifted. In some cases, the incremental weight is quite small; e.g., 0.25 to 2.5 lbs. (i.e., approx. 0.11 kg to 1.15 kg). In other cases, it can be greater or smaller.

Generally, incremental weights are used to rehabilitate injured muscles and ligaments, wherein small increases/decreases in resistance are needed in the course of rehabilitation exercises. In other cases, small incremental weights are useful where the user is exercising smaller muscle groups or is older or physically weak or has reached a "plateau" that is preventing a major increase to the next full increment of lifted poundage.

The use of magnetically mountable incremental weights is known as one means to quickly and conveniently add and subtract such weight. For example, U.S. Pat. No. 5,735,777 describes the use and application of magnetic "adaptive weights" that are removably attached to dumbbells and barbells. The content of that patent is hereby incorporated by reference.

The advantages of magnetically coupled incremental weights have been offset by a number of deficiencies. First, they have not been usable with non-metallic weight plates, despite the fact that many dumbbells frequently utilize weight plates made from plastic, rubber and/or other non-magnetic materials. In addition to being less expensive to manufacture, for example, both plastic and rubber weight plates are less likely to cause chipping, marring and other surface damage to surrounding home furnishings and/or surrounding gym equipment such as racks and neighboring devices. Additionally, weight plates of such materials are less likely to damage inadvertently contacted woodwork, floors and walls. Moreover, weight plates made from such material can be more durable in that they are more likely to retain their aesthetic appearance because they are not susceptible, as with poorly plated metal weight plates, to chipping and rusting. Accordingly, the inability to use magnetically coupled incremental weight plates with increasingly popular non-magnetic dumbbell and barbell weight plates is a severe limitation.

Secondly, there is a need for strong magnetic attraction between the incremental weight plate and the dumbbell to which it is attached, but that makes it difficult to remove the incremental weight plate. Strong magnetic attraction is desired owing to safety concerns that arise whenever a weight plate can fall from an exercise device or become loose and distracting. In addition, an incremental weight that shifts position during an exercise movement can cause a dynamic imbalance that detracts from the safety and efficacy of the exercise movement.

SUMMARY OF THE INVENTION

The invention herein is directed to dumbbells having weight plates onto which magnetically coupled incremental weight plates can be securely mounted. The invention herein includes an adaptor and a method to convert conventional dumbbells into an improved configuration that can utilize magnetically-coupled incremental weight plates.

Incremental weight plates are known in the art. They are typically annular, with the central aperture being sized to fit about the bar of the dumbbell. It should be recognized, however, that the incremental weight plate need not be round; it can be of any desired shape. As used throughout this specification, the term "annular" shall accordingly not be limited to denote a round shape, but will instead denote any and all shapes having a through-opening. Moreover, the term "annular" as used herein shall encompass shapes having a through-hole that is not necessarily centrally located. Lastly, and as previously stated, the term "dumbbell" includes dumbbells and barbells, individually and collectively.

A dumbbell in accordance with the invention comprises a generally cylindrical bar extending generally axially between a pair of end regions respectively terminating at a respective end of the bar, at least one weight plate mounted about each end region, a generally annular member securely mounted about the bar at least one end region between the weight plate and the end of the bar, said generally annular member having (a) a hub portion for accommodating the through-opening of a generally annular incremental weight plate, and (b) a flange portion of greater exterior dimension than the hub portion and having at least one generally magnetically-responsive region for securing an incremental weight via magnetic force when said incremental weight plate is mounted about said hub region, and means securing said generally annular member to the bar.

In accordance with the invention, an adaptor is provided for use with a dumbbell having non-magnetic weight plates. The adaptor comprises a generally annular member having (a) a hub portion having an inner dimension sized to fit around the dumbbell's bar and an outer dimension sized to fit through the through-hole of an incremental weight plate and (b) a generally annular flange portion of greater exterior dimension than the hub portion and having at least one magnetically-responsive region for securing an incremental weight via magnetic force when said incremental weight plate is mounted about said hub region, and means for permitting the adaptor to be secured to the bar.

An adaptor constructed in accordance with the invention is slid onto the dumbbell, flange-end first so that the flange portion is closer to the dumbbell's weight plate than the hub region. The adaptor is secured to the bar. When needed, an incremental weight plate is slid over the hub portion, and is secured to the flange portion by magnetic attraction between the magnetically responsive regions of the flange portion and incremental weight plate.

The magnetically-responsive region of the flange, in the aforedescribed dumbbell and in the aforedescribed adaptor, may be a magnet positioned to magnetically secure the incremental weight plate. Alternatively, the magnetically-responsive portion of the flange need not include a magnet if the secured portion of the incremental weight plate includes a magnet.

Moreover, both the magnetically-responsive portion of the flange and the secured portion of the incremental weight can include a magnet in accordance with an optional feature of the invention, wherein an appropriate orientation of the magnets' poles results in a magnetically-aided removal feature when the user wishes to remove the incremental weight plate from the dumbbell. Briefly, the adaptor and the incremental weight plate include magnetic regions whose poles are mutually oriented so that the incremental weight plate is magnetically attracted to the flange for secure mounting when the incremental weight plate is in a first position about the bar, and so that the flange and incremental weight plate repel each other when the incremental weight plate is rotated sufficiently about the bar from its first position.

These and further details of the invention will be apparent to those of ordinary skill in the art from reading a description of the preferred embodiment of the invention described below, and of which the drawing forms a part.

DESCRIPTION OF THE DRAWING

Of the preferred embodiments to be described hereinbelow.

DESCRIPTION OF THE PREFERRED EMBODIMENT

Figure 1:
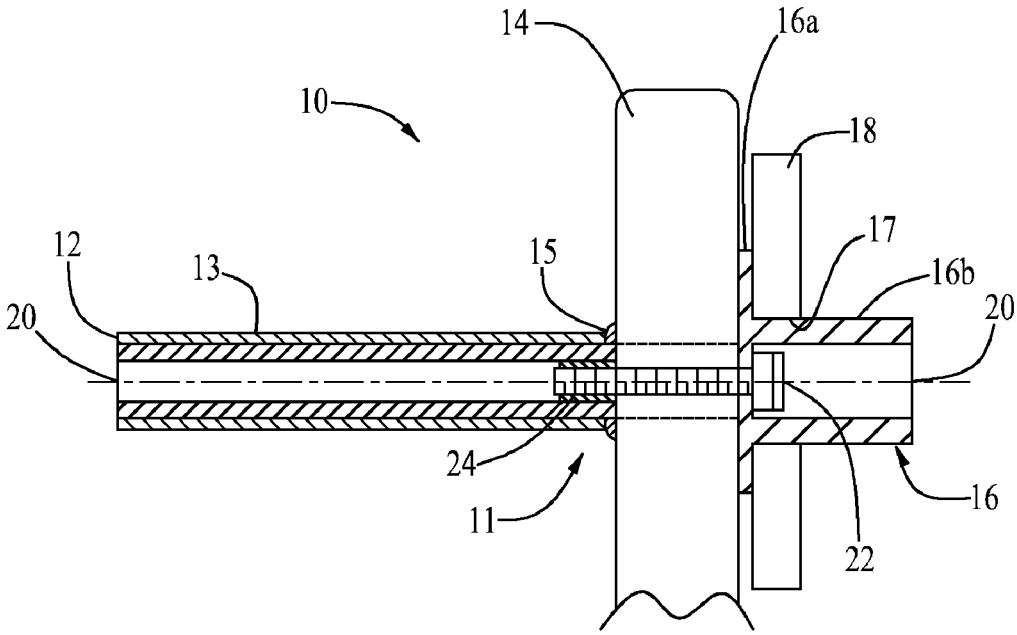
FIG. 1 is a front fragmentary elevation view in longitudinal section showing one end of a fixed weight dumbbell incorporating the invention herein.

FIG. 1 is a front elevation view shoving the right end of a "fixed weight" type dumbbell 10 constructed in accordance with the invention herein. As is known, the left end (not illustrated) is preferably a mirror image of the right end. As stated hereinabove, the term "dumbbell" is used to denote both dumbbells and barbells.

As is known in the art, the dumbbell 10 comprises a generally cylindrical bar 12 extending axially between two end regions, the right end region 11 being illustrated in FIG. 1. A tubular handle 13 typically extends co-axially about the bar for gripping by the user, and includes any of a number of surface features to enhance a secure grip by the user. A weight plate mass in the form of a single illustrated weight plate 14 is mounted about the bar 12 axially inward of the right end region 11. The weight plate 14 is preferably formed from a non-magnetically-responsive material. Common examples of such material are plastic and rubber compounds. Those skilled in the art recognize that more than one weight plate may be mounted at each end region to yield the desired total weight plate mass of the dumbbell. It may also be recognized that the scope of the invention herein is not dependant on the weight plate 14 being non-magnetic although the invention is primarily directed to dumbbells with non-magnetically-responsive weight plates.

A generally annular sleeve 16 having a flange portion **16*a* and a hub portion 16*b* is mounted on the bar axially outward of the weight plate 14. Preferably, the same is true at the unillustrated left end of the dumbbell. The annular sleeve has an inner diameter that fits over the bar 11, and is slid axially inward over the bar until it reaches the weight plate 14 or other stop surface designed into the dumbbell. The outer diameter of the flange portion 16 a is preferably less than that of the weight plate 14, but greater than that of the hub portion 16*b*. The outer diameter is preferably less than that of the weigh plate 14** because, as will be shown, it is not necessary to have the same or greater diameter and, more importantly, it is highly undesirable to have it protrude radially from the dumbbell so as to potentially cause damage to surrounding items that it strikes or be damaged itself if the dumbbell is dropped onto the floor or other surface.

Figure 2:
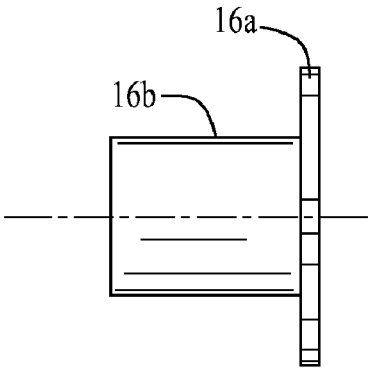
FIG. 2 is a front elevation view of the sleeve 16 of FIG. 1 constructed in accordance with the invention.

The hub portion **16*b* of the sleeve 16 has an outer diameter sized to fit through the generally central through-opening 17 of incremental weight plate 18. Incremental weight plate 18 is magnetically secured to the abutting surface of the flange portion 16*a* by providing one or more appropriately oriented magnets in the flange and/or incremental weight plate. By way of example, reference is made to FIGS. 2 and 3 which respectively show front elevation and right side elevation views of the generally annular sleeve of FIG. 1. A pair of magnets 30, 32 is shown affixed to the axially-outward surface of the flange portion 16*a***. The magnets can be affixed to the surface, or embedded in the surface so as to be flush therewith or slightly below it. The face of the magnets can be exposed or be internally disposed within the flange. Moreover, the magnets, and/or the magnetic region created within the flange, can be of any desirable shape within the radially-extending region between the ID and OD of the flange, and can be at as many regions around the flange as desirable.

Figure 3:
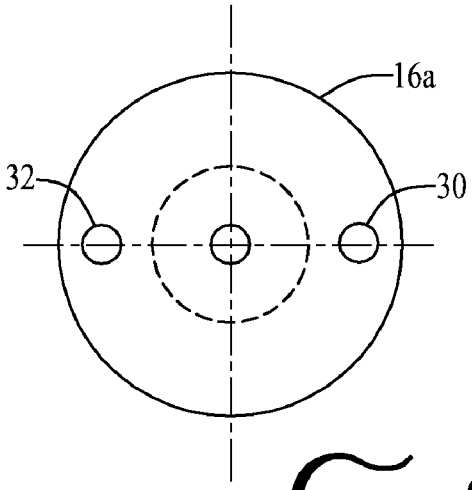
FIG. 3 is a right side elevation view of the sleeve shown in FIG. 2.

Thus, although two magnetic regions are shown in FIG. 3, there may be one such region, four such regions, six such regions or any other desired number.

Figure 4:
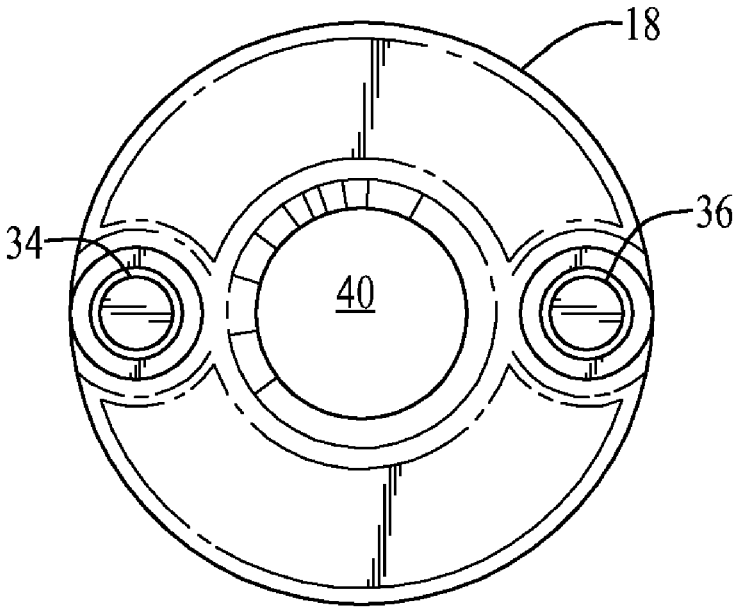
FIG. 4 is a left side elevation view of an incremental weight plate in FIG. 1 constructed in accordance with the invention

FIG. 4 is a left side elevation view of the preferred incremental weight plate 18 shown in FIG. 1. The incremental weight plate 18 is generally annular, having a generally central opening 40 and can be formed from either a magnetically-responsive material or a non-magnetically responsive material. Examples of the latter include rubber-based mixtures and plastic materials. In the case where magnetically-responsive materials are used, the incremental weight plate will be attracted to the magnetic region(s) of the flange 16(*a*) and thereby secured to the dumbbell. When the user desires to remove the incremental weight plate from the dumbbell, it is done in the conventional manner by applying an axially outwardly directed separating force against the incremental weight plate relative to the dumbbell.

When the incremental weight plate is made from a non-magnetically responsive material, one or more magnetically-responsive regions 34, 36 can be affixed to, or imbedded within, the incremental weight plate to interact with those of the flange and thereby magnetically secure the incremental weight plate on the dumbbell. For example, magnetic regions 30, 32 of the flange (FIG. 3) can interact with magnets 34, 36 of the incremental weight plate (FIG. 4) to secure the incremental weight plate to the dumbbell.

The orientation of the magnets 34, 36 of the incremental weight plate can be utilized to provide a feature by which the incremental weight plate can be easily detached from the dumbbell. Specifically the face of magnets 34, 36 abutting the flange 16*a* are provided with opposite polarities, as are the magnetic regions 30, 32 of the flange. For example, if magnets 34, 36 respectively have the north and south pole facing the flange, and the magnetic regions 30, 32 respectively have the south and north pole facing the incremental weight plate, the incremental weight plate will be securely mounted to the dumbbell when the flange's magnetic region 30 abuts the incremental weight plate's magnet 34 and the flange's magnetic region 32 abuts the incremental weight plate's magnet 36. Because of the magnetic attraction, removal of the incremental weight plate might be difficult, particularly since strong magnetically attractive forces are preferred in order to assure that the incremental weight plate does not slip from the dumbbell or move during the exercise movement. By rotating the secured incremental weight plate about the hub 16*b* on which it is mounted, however, and generally aligning the incremental weight plate's magnet 34 with the flange's magnetic region 32, the two will be caused to repel each other because of their now-abutting north poles. Similarly, the flange's magnetic region 30 will repel the incremental weight plate's magnet 36 owing to their abutting south poles. Consequently, the incremental weight plate will space itself from the flange, making its removal very easy.

Returning to FIG. 1, the weight plates 14 can be secured to the bar of the dumbbells by any of a number of means. For example, the weight plates may simply be captured between a flange 15 formed at the axially outward end of the handle 13 and the axially inward surface of the flange 16*a* which can be used in lieu of the conventionally used dumbbell collar. Accordingly, the annular sleeve 16 can be affixed to the barbell in a manner substantially identical to the manner by which conventional collars are affixed. For example, and as illustrated in FIG. 1, the sleeve 16 can be affixed to the dumbbell by means of a fastener such as an externally threaded bolt 22 that mates with an internally threaded region 24 at each end of the bar. The sleeve 16 accordingly includes a bolt-accommodating through-hole formed, preferably centrally, in its flange so that the bolt 22 can be tightened into the bar to secure the weight plate 14 between the collar 15 and the axially-inward surface the flange 16*a*.

Figure 5:
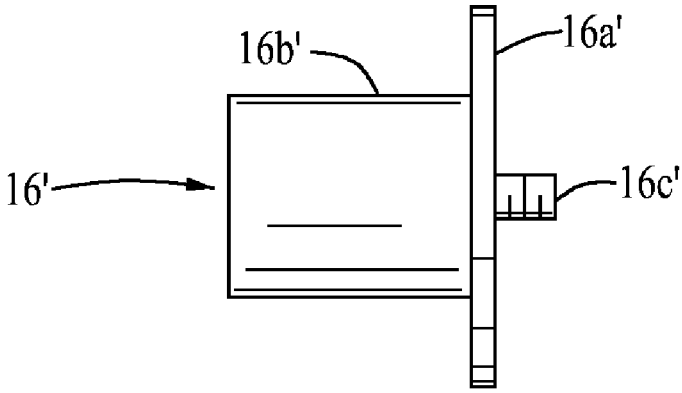
FIG. 5 is a front elevation view of an alternative sleeve constructed in accordance with the invention.

Alternatively, an axial sleeve having an externally threaded bolt-like protrusion can be utilized. As illustrated in FIG. 5, an annular sleeve 16' having an internally-threaded shaft segment 16*b*' protruding from its flange 16*a*' can be screwed via that shaft into the internally-threaded end of the dumbbell's bar. The shaft segment 16*c*' can be affixed to the sleeve 16 by any known means. For example, it can be force-fit through an opening in the flange 16*a*', or welded to the flange or secured by any one of numerously available chemical and/or mechanical fastening means.

The sleeve 16 is also adaptable for use with adjustable dumbbells, both as an adapter to be used with pre-existing dumbbells, and as a component of an improved dumbbell. Adjustable dumbbells are known, for example, that have bars with externally threaded end sections. Dumbbells of this type utilize an internally threaded collar at each end of the dumbbell. Each collar is threaded onto the bar after the weight plates at that end of the bar has been mounted, and rotated so that it advances progressively towards the handle of the dumbbell until it secures the mounted weight plate(s) against the respective flange (or other plate-stopping surface).

Figure 6:
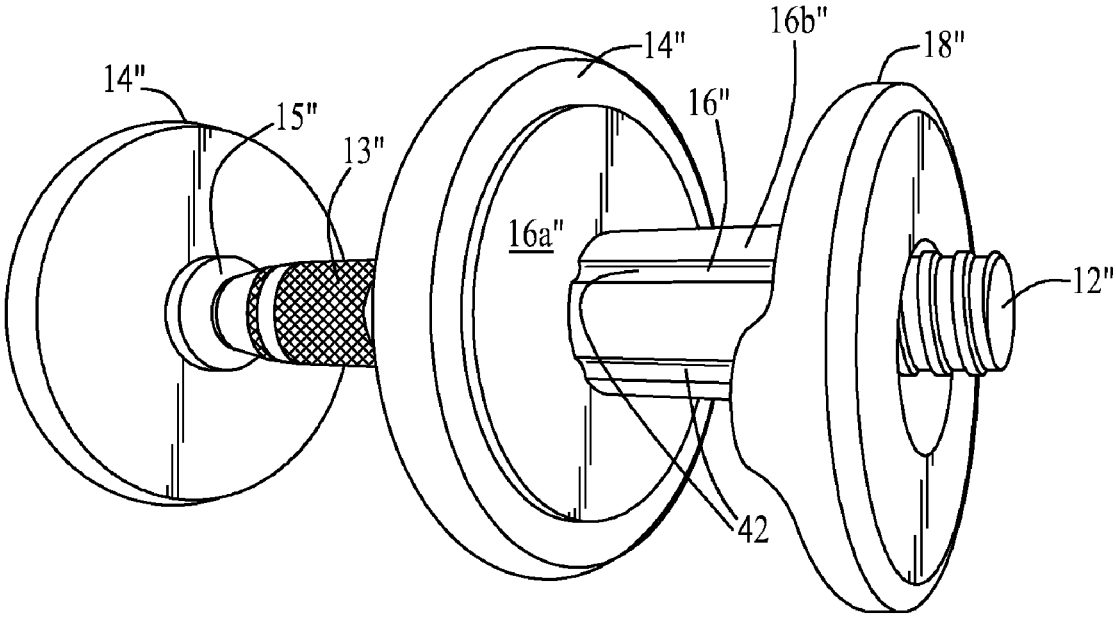
FIG. 6 is a front perspective view of a second embodiment of a dumbbell constructed in accordance with the invention.

As illustrated in FIG. 6, a sleeve 16" can be utilized with an internally-threaded hub segment 16*b*" to secure incremental weight plates to dumbbells of the type having externally threaded bars 12". The internally threaded hub mates with the external threads of the bar so that the sleeve can be rotated onto the bar until the weight plates 14" are captured between the axially inward face of the flange 16*a*" and the handle's flange 15" (or other plate-stopping surface).

The sleeve 16" is screwed into the bar 12" until the flange 16*a*" contacts the weight plate 14" and captures it against the handle 13". A surface feature on the sleeve, such as axially-extending slots 42, can be provided as a wrench-engaging surface to enhance the user's ability to securely tighten the sleeve onto the dumbbell. Moreover, the surface feature enhances the sleeve's grippability so that a user can more securely tighten the sleeve by hand if a wrench is not used, but the use of a wrench is highly preferred for security. Other surface features, such as axially-extending flats or sleeves of polygonal cross-section, that can be readily gripped by a wrench or the human hand can be utilized as well. While it is recognize that the flange may be provided with wrench-accommodating surfaces as well, and it is intended that such surfaces be included within the scope of the invention. it is believed that the formation of such surfaces in the hub is more practical. As before, an incremental weight plate 18" can then be mounted over the hub 16*b*" of the sleeve, as desired, to be magnetically secured to the flange 16*a*" whether or not the weight plate 14" is magnetically responsive.

Figure 7:
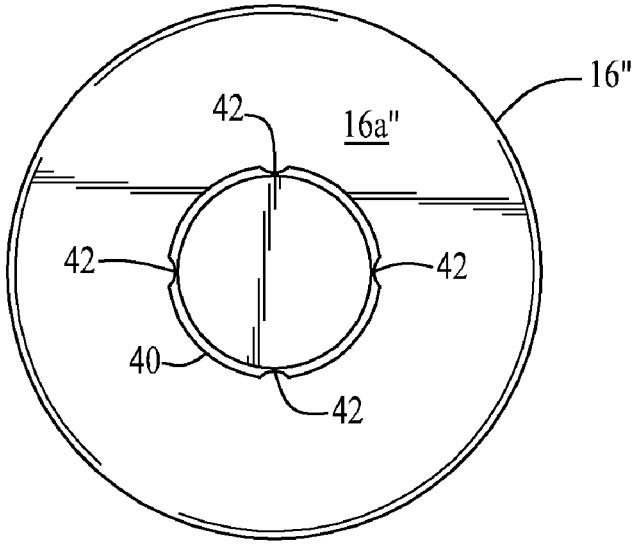
FIG. 7 is a left side elevation view of the sleeve 16" illustrated in FIG. 6.

Returning to FIGS. 1 and 5, those of ordinary skill in the art will recognize that the sleeves 16, 16' can be utilized as an adapter for conventional dumbbells wherein the weight plate 14 is secured to the bar by a collar and an internally threaded bolt. In this way, a dumbbell having nonmagnetic weight plates can be adapted to accommodate a magnetically-secured incremental weight plate. Accordingly, the sleeve functions as an aftermarket adapter for use with conventional dumbbells, as well as being an original component of an improved dumbbell. Likewise, the sleeve 16" illustrated in FIGS. 6 and 7 can be used as aftermarket adaptors for conventional dumbbells having externally threaded bars.

Those of ordinary skill in the art will recognize that alternative means for releasably securing the incremental weight plate to the dumbbell can be used in place of the magnets described above. For example, the flange portion of the annular sleeve and the incremental weight plate can be fit with complimentary strips of adhesive-backed Velcro® to reliably but releasably secure the incremental weight plate against movement on the hub portion during the exercise movement.

Although the present invention and its advantages have been described in detail, it should accordingly be understood that various changes, substitutions and alterations can be made herein without departing from the spirit and scope of the invention as will be defined by the appended claims.

I claim:

1. A dumbbell comprising:

a bar that extends generally axially between opposing end regions, a weight plate mass mounted about the bar at each end region, means for retaining the mounted weight plate mass at the respective end regions to define a handle region axially inward of the end regions that can be gripped by a user during exercise movement of the dumbbell, a sleeve member of generally annular cross-section securely mounted about the bar at at least one end region axially outward from the weight plate, said sleeve member having (a) a hub portion for accommodating the through-opening of a generally annular incremental weight plate, and (b) a flange portion of greater exterior dimension than the hub portion and having at least one magnetically-responsive region for securing an incremental weight via magnetic force to the dumbbell when said incremental weight plate is mounted about said hub region, said hub portion extending from the flange portion axially outward of the weight plate mass to accommodate the through-opening of the incremental weight plate, and means securing said sleeve member to the bar.

2. The dumbbell of claim 1 wherein the weight plate mass at each end region is formed from a material that is not magnetically responsive.

3. The dumbbell of claim 1 wherein the flange portion of the sleeve member abuts the axially-outermost surface of the weight plate mass.

4. The dumbbell of claim 3 wherein the flange portion contacts the axially-outermost surface of the weight plate mass.

5. The dumbbell of claim 3 wherein the generally radial dimension of the flange portion is less than that of the weight plate mass, but greater than that of the hub portion.

6. The dumbbell of claim 1 wherein the magnetically-responsive region of the flange portion is formed from at least one magnet having an axially-outward facing magnetic pole.

7. The dumbbell of claim 6 wherein the flange portion has a pair of magnets positioned generally diametrically opposite each other.

8. The dumbbell of claim 7 wherein the axially-outward facing pole of one of the magnets is the magnetic opposite of the polarity of the axially-outward facing pole of the other of the magnets.

9. The dumbbell of claim 1 including an incremental weight plate having a through-hole accommodating the passage of the hub portion to enable the incremental weight plate to be mounted on the dumbbell, the incremental weight plate having a magnetically responsive region positioned for magnetic attraction to the magnetically-responsive region of the flange portion of the sleeve member to magnetically secure the incremental weight plate to the dumbbell, at least one of the magnetically-responsive regions being a magnet.

10. The dumbbell of claim 9 wherein the flange portion has an axially outward-facing surface that contacts an axially-inward-facing surface of the mounted incremental weight plate.

11. The dumbbell of claim 9 wherein the incremental weight plate is, but for the magnetically-responsive region, formed from a non-magnetically responsive material.

12. The dumbbell of claim 11 wherein the incremental weight plate and the flange portion of the sleeve have respective pairs of magnetically-responsive regions positioned to interact when the incremental weight plate is mounted about the hub portion of the sleeve and adjacent the flange, the pair associated with at least one of the flange portion and incremental weight plate being of opposite magnetic polarities.

13. The dumbbell of claim 12 wherein the pair associated with each of the flange portion and incremental weight plate are of opposite magnetic polarities.

14. The dumbbell of claim 13 wherein the incremental weight plate is manually rotatable about the hub portions to selectively bring the magnetic regions of the incremental weight plate into a magnetically attracting position vis-à-vis the magnetic regions in the flange portion and into a magnetically repelling position vis-à-vis the magnetic regions in the flange portion.

15. The dumbbell of claim 1 wherein the flange portion of the sleeve includes at least one magnet.

16. The dumbbell of claim 15 wherein the flange portion of the sleeve includes a pair of generally diametrically opposite magnets.

17. The dumbbell of claim 15 wherein the flange portion of the sleeve includes a pair of magnets at the axially-outward surface of the flange portion.

18. The dumbbell of claim 17 wherein the magnets are affixed to the surface of the flange portion.

19. The dumbbell of claim 18 wherein the magnets are embedded in the surface of the flange portion.

20. The dumbbell of claim 19 wherein each of the magnets has an axially inner face and an axially outer face, and the axially outer face of each magnet is internally disposed within the flange portion.

21. The dumbbell of claim 1 wherein the end regions of the bar are internally threaded, and the sleeve member includes an externally-threaded means for engaging said internally threads to securing the sleeve member to the bar.

22. The dumbbell of claim 21 including a bolt member having an externally threaded shank and a head of larger cross-section than the shank, wherein the flange portion of the sleeve member has an axially-inwardly-facing face with a shank-accommodating through-hole of smaller cross section than the head of the bolt, the threaded shank of the bolt protruding generally axially into the internally threaded end region of the bar to secure the sleeve member to the dumbbell through inter-engagement of the respective threads.

23. The dumbbell of claim 1 wherein the end regions of the bar are externally threaded, and the sleeve member is internally-threaded for engaging said external threads for securing the sleeve member onto the bar.

24. The dumbbell of claim 23 wherein the sleeve is internally threaded within the hub portion so that the sleeve can be rotated onto the bar until the weight plate mass is captured between the axially inward face of the flange portion and the handle of the dumbbell.

25. The dumbbell of claim 1 wherein the sleeve includes a surface feature to enhance its grippability so that sleeve can be more readily tightened onto the bar.

26. The dumbbell of claim 25 wherein the surface feature is at least one axially-extending flat surface region.

27. The dumbbell of claim 26 wherein at least a region of the sleeve has a polygonal cross-section.

28. The dumbbell of claim 1 including an incremental weight plate having a through-hole accommodating the passage of the hub portion to enable the incremental weight plate to thereby be mounted on the dumbbell, the incremental weight plate and flange region having magnetically responsive regions positioned to magnetically secure the incremental weight plate to the dumbbell, at least one of said magnetically-responsive regions being a magnet, the incremental weight plate and flange portion having magnets positioned to magnetically repel the incremental weight plate from the flange portion when the incremental weight plate is manually rotated about the hub to cause said magnets into interact.

29. An adaptor for releasably securing incremental weight plates to a dumbbell of the type including a bar that extends generally axially between opposing end regions, at least one weight plate mounted about the bar at each end region, and means for maintaining the mounted weight plates at the respective end regions to define a handle region axially inward of the end regions, said adaptor of generally annular cross-section and having (a) a hub portion of an inner dimension sized to fit around the dumbbell's bar and an outer dimension sized to fit through the through-hole of an incremental weight plate, (b) a flange portion of greater exterior dimension than the hub portion and having at least one magnetically-responsive region for securing an incremental weight to the adaptor via magnetic force when said incremental weight plate is mounted about said hub portion in a first position, and further having at least one region positioned to not secure the incremental weight plate to the adaptor via magnetic force when said incremental weight plate is rotated about said hub portion away from said first position, and (c) means for permitting the adaptor to be secured to the bar.

30. The adaptor of claim 29 wherein the flange portion includes a pair of separated magnetically-responsive regions.

31. The adaptor of claim 30 wherein the pair of magnetically-responsive regions are disposed on generally diametrically opposite sides of the flange portion.

32. The adaptor of claim 31 wherein the pair of magnetically-responsive regions are magnets of opposite magnetic polarities.

33. A dumbbell comprising:

a bar that extends generally axially between opposing end regions, a weight plate mass mounted about the bar at each end region, means for retaining the mounted weight plate mass at the respective end regions to define a handle region axially inward of the end regions that can be gripped by a user during exercise movement of the dumbbell, a sleeve member of generally annular cross-section securely mounted about the bar at at least one end region axially outward from the weight plate, said sleeve member having (a) a hub portion for accommodating the through-opening of a generally annular incremental weight plate, and (b) a flange portion of greater exterior dimension than the hub portion and having at least one magnetically-responsive region for securing an incremental weight via magnetic force to the dumbbell when said incremental weight plate is mounted about said hub region, and means securing said sleeve member to the bar, wherein the magnetically-responsive region of the flange portion is formed from at least one magnet having an axially-outward facing magnetic pole.

34. The dumbbell of claim 33 wherein the flange portion has a pair of magnets positioned generally diametrically opposite each other.

35. The dumbbell of claim 34 wherein the pole of the axially-outward facing pole of one of the magnets is the magnetic opposite of the polarity of the axially-outward facing pole of the other of the magnets.

36. A dumbbell comprising:

a bar that extends generally axially between opposing end regions, a weight plate mass mounted about the bar at each end region, means for retaining the mounted weight plate mass at the respective end regions to define a handle region axially inward of the end regions that can be gripped by a user during exercise movement of the dumbbell, a sleeve member of generally annular cross-section securely mounted about the bar at at least one end region axially outward from the weight plate, said sleeve member having (a) a hub portion for accommodating the through-opening of a generally annular incremental weight plate, and (b) a flange portion of greater exterior dimension than the hub portion and having at least one magnetically-responsive region for securing an incremental weight via magnetic force to the dumbbell when said incremental weight plate is mounted about said hub region, means securing said sleeve member to the bar, and an incremental weight plate having a through-hole accommodating the passage of the hub portion to enable the incremental weight plate to be mounted on the dumbbell, the incremental weight plate having a magnetically responsive region positioned for magnetic attraction to the magnetically-responsive region of the flange portion of the sleeve member to magnetically secure the incremental weight plate to the dumbbell, at least one of said magnetically responsive regions being a magnet.

37. The dumbbell of claim 36 wherein the flange portion has an axially outward-facing surface that contacts an axially-inward-facing surface of the mounted incremental weight plate.

38. The dumbbell of claim 36 wherein the incremental weight plate is, but for the magnetically-responsive region, formed from a non-magnetically responsive material.

39. The dumbbell of claim 38 wherein the incremental weight plate and the flange portion of the sleeve have respective pairs of magnetically-responsive regions positioned to interact when the incremental weight plate is mounted about the hub portion of the sleeve and adjacent the flange, the pair associated with at least one of the flange portion and incremental weight plate being of opposite magnetic polarities.

40. The dumbbell of claim 39 wherein the pair associated with each of the flange portion and incremental weight plate are of opposite magnetic polarities.

41. The dumbbell of claim 40 wherein the incremental weight plate is manually rotatable about the hub portions to selectively bring the magnetic regions of the incremental weight plate into a magnetically attracting position vis-à-vis the magnetic regions in the flange portion and into a magnetically repelling position vis-à-vis the magnetic regions in the flange portion.

42. A dumbbell comprising:

a bar that extends generally axially between opposing end regions, a weight plate mass mounted about the bar at each end region, means for retaining the mounted weight plate mass at the respective end regions to define a handle region axially inward of the end regions that can be gripped by a user during exercise movement of the dumbbell, a sleeve member of generally annular cross-section securely mounted about the bar at at least one end region axially outward from the weight plate, said sleeve member having (a) a hub portion for accommodating the through-opening of a generally annular incremental weight plate, and (b) a flange portion of greater exterior dimension than the hub portion and having at least one magnet for securing an incremental weight via magnetic force to the dumbbell when said incremental weight plate is mounted about said hub region, and means securing said sleeve member to the bar.

43. The dumbbell of claim 42 wherein the flange portion of the sleeve includes a pair of generally diametrically opposite magnets.

44. The dumbbell of claim 42 wherein the flange portion of the sleeve includes a pair of magnets at the axially-outward surface of the flange portion.

45. The dumbbell of claim 44 wherein the magnets are affixed to the surface of the flange portion.

46. The dumbbell of claim 45 wherein the magnets are embedded in the surface of the flange portion.

47. The dumbbell of claim 46 wherein each of the magnets has an axially inner face and an axially outer face, and the axially outer face of each magnet is internally disposed within the flange portion.

48. An adaptor for releasably securing incremental weight plates to a dumbbell of the type including a bar that extends generally axially between opposing end regions, at least one weight plate mounted about the bar at each end region, and means for maintaining the mounted weight plates at the respective end regions to define a handle region axially inward of the end regions, said adaptor of generally annular cross-section and having (a) a hub portion of an inner dimension sized to fit around the dumbbell's bar and an outer dimension sized to fit through the through-hole of an incremental weight plate, (b) a flange portion of greater exterior dimension than the hub portion and having at least one magnetically-responsive region for securing an incremental weight to the adaptor via magnetic force when said incremental weight plate is mounted about said hub portion, and (c) means for permitting the adaptor to be secured to the bar, the flange portion includes a pair of separated magnetically-responsive regions disposed on generally diametrically opposite side of the flange region, wherein the pair of magnetically-responsive regions are of opposite magnetic polarities.

* * * * *